United States Patent [19]

Martinec et al.

[11] 4,225,999

[45] Oct. 7, 1980

[54] MULTI-MOTOR SUCTION CLEANER CONSTRUCTION

[75] Inventors: Eugene F. Martinec, East Cleveland; Nora Robinson, Cleveland, both of Ohio

[73] Assignee: Health-Mor Inc., Cleveland, Ohio

[21] Appl. No.: 31,988

[22] Filed: Apr. 20, 1979

[51] Int. Cl.[3] ..... A47L 5/14

[52] U.S. Cl. ..... 15/300 A; 15/330; 15/337; 15/351

[58] Field of Search ..... 15/331, 334, 335, 336, 15/337, 300 A, 350, 351

[56] References Cited

U.S. PATENT DOCUMENTS

| | | | |
|---|---|---|---|
| 1,787,537 | 1/1931 | Leahy . | |
| 2,064,587 | 12/1936 | Carlstedt . | |
| 2,140,143 | 12/1938 | Sellers et al. | 15/337 X |
| 2,218,035 | 10/1940 | Benson . | |
| 2,648,396 | 8/1953 | Kirby . | |

FOREIGN PATENT DOCUMENTS

| | | | |
|---|---|---|---|
| 551975 | 1/1958 | Canada | 15/300 A |
| 805890 | 12/1958 | United Kingdom | 15/300 A |

*Primary Examiner*—Christopher K. Moore
*Attorney, Agent, or Firm*—Frease & Bishop

[57] ABSTRACT

A multi-motor suction cleaner of the upright type having a power-driven rotary brush operated in the usual manner with a low-suction, high-volume airflow produced by a typical first motor-fan unit in the cleaner suction nozzle housing to carry out a usual floor, rug or carpet cleaning operation. The cleaner is converted to efficient off-the-floor cleaning merely by selectively uncovering an opening in a closed suction chamber carried by the cleaner containing a second motor-fan unit producing high-suction, low-volume airflow. A converter member mounted on one end of a typical flexible attachment hose is inserted in the uncovered opening. This automatically energizes the second motor-fan unit. The selective and alternate operation of the two motor-fan units provides a single cleaner that can carry out most efficiently every cleaning operation heretofore requiring both a canister and an upright cleaner to perform. In addition, the cleaner is convertible to blower operation by connecting the converter member to a blower receptacle also provided for the closed compartment.

32 Claims, 28 Drawing Figures

FIG. 6
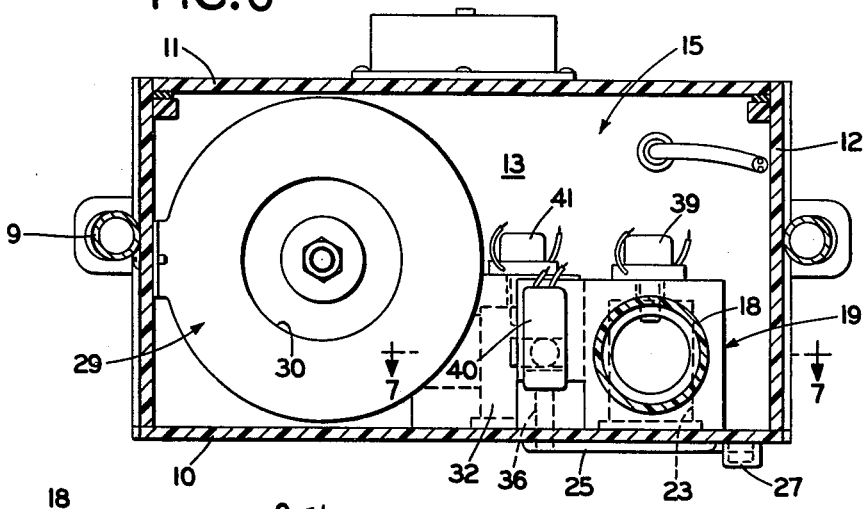
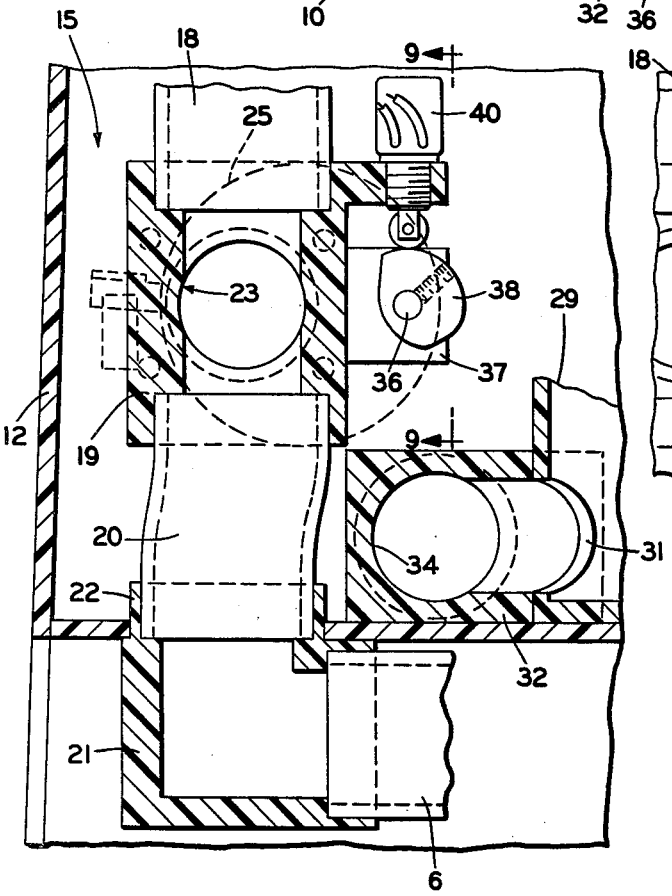
FIG. 7
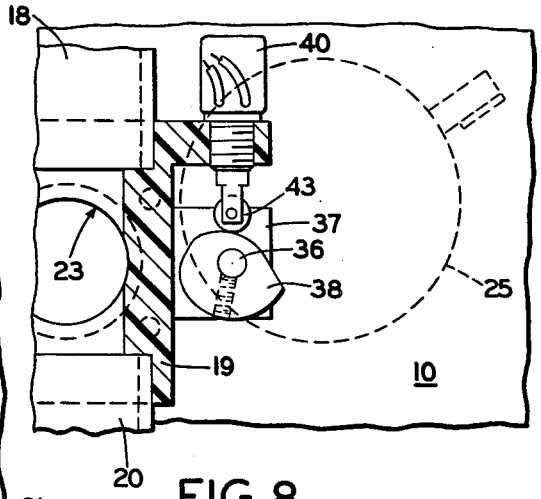
FIG. 8
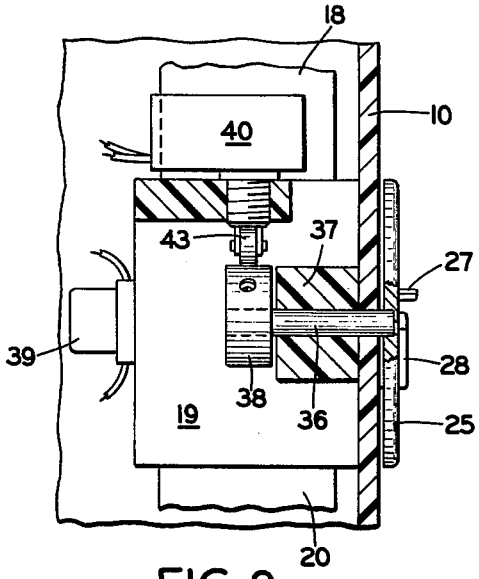
FIG. 9

MULTI-MOTOR SUCTION CLEANER CONSTRUCTION

BACKGROUND OF THE INVENTION

1. Field of the Invention

The invention relates to suction cleaners and more particularly to a dual function cleaner, generally of the upright or floor cleaner type having a roller mounted nozzle housing and a rotary brush adjacent the nozzle in the housing, the cleaner being manipulated by a pivoted handle, and normally being operable for usual rotary brush and suction rug and floor cleaning operation; in which the cleaner is operable through converter mechanism to which various nozzle attachments on wands and flexible hose may be connected for off-the-floor cleaning of upholstery, draperies and the like; and in which when operated for rotary brush rug cleaning low-suction, high-volume airflow is present at the rotary brush nozzle, and when operated for off-the-floor cleaning, high-suction, low-volume airflow is present at any selected nozzle attached to the flexible hose and wand.

2. Description of the Prior Art

Shortly after the advent in the art of the typical upright or portable floor cleaning suction cleaner, it became apparent that different cleaning operations required different degrees of suction; and there are prior patents in the art which at least fifty years ago described the desirability of such suction cleaner which could provide at least two different degrees of suction for different cleaning operations. Such desirable suction characteristics in upright cleaners have continued to be indicated as objectives in many prior patents during the past fifty years.

Some of these prior patents assert that their disclosures solve the problem by providing a single cleaner motor with a plurality of fans driven by that motor either individually or in tandem or in series. However, these proposals really provide no solution of the problem because it has been found that no one motor of a size and cost practical for use in an upright suction cleaner can provide the characteristics of fan operation necessary for producing low-suction, high-volume air movement in a rotary brush driven rug cleaning upright cleaner, and at the same time provide high-suction, low-volume airflow for separate off-the-floor cleaning using a flexible hose and wand with nozzle attachments.

The usual relatively low speed motor is most efficient for fan operation in normal rug cleaning use of an upright cleaner with a power driven brush. However, a relatively high speed motor driven fan is necessary to develop the high suction required for separate off-the-floor cleaning.

As a result, householders frequently have acquired two types of suction cleaners, a usual upright cleaner with power driven brush for performing rug and floor cleaning operations; and a second tank or canister-type cleaner having hose, wand and nozzle attachments for performing off-the-floor cleaning.

One example of a multi-suction prior art upright suction cleaner is disclosed in Leahy U.S. Pat. No. 1,787,537 which asserts that it solves the problem recognized more than fifty years ago by providing a cleaner with a plurality of nozzles and a plurality of fans driven by a single motor. This disclosure failed to recognize the impossibility, with a single motor, of developing the degree of high suction required in one mode of operation and the usual degree of low suction normally present in a driven agitator-type floor cleaner.

Another example of a multi-suction cleaner is disclosed in Carlstedt U.S. Pat. No. 2,064,587. The cleaner of this patent draws air into a nozzle and then discharges it directly into a dust bag, the suction being effective outside of the dust bag and within a container. There is one motor with a fan at either end of the motor shaft. There is a valve so that the two fans may be connected either in parallel or in series. Thus, two different degrees of suction are possible. However, such alternate operation with one motor does not really produce high suction of the degree required for efficient attachment-tool cleaning.

Another example of a dual-operating motor-driven suction cleaner is disclosed in Benson U.S. Pat. No. 2,218,035. The cleaner has one motor with a fan on each end of the motor shaft and a power driven brush. When operated for floor cleaning, the brush is driven by the motor as well as both fans. This patent suggests that the two fans will produce the greater suction effect essential for dirt removal from floor coverings, while the upper fan will be sufficient for cleaning articles other than floor coverings. Here, again, Benson failed to appreciate that the degree of high suction necessary for efficient off-the-floor cleaning can only be produced by a high-speed motor and not by a motor that drives one or more fans for agitated rug cleaning.

Still another example of a prior art patent that notes the problem existing regarding different requirements for floor cleaning and off-the-floor cleaning is Kirby U.S. Pat. No. 2,648,396 which indicates that the problem still existing at that time had made it necessary for the usual home to have two types of cleaners for the two indicated types of cleaning. Again, Kirby has the same motor with the same two-stage fan that provides suction for normal floor cleaning and also provides the same suction for off-the-floor cleaning.

As previously stated, no one motor of a size and cost practical for a suction cleaner can provide fan operation necessary for producing low suction and high suction for separate rug and off-the-floor cleaning.

A number of upright type suction cleaners currently are on the market of many different designs which seek to provide low-suction and high-suction operation for rug and off-the-floor cleaning. All of these cleaners have a single motor and use various arrangements for obtaining a change in the degree of nozzle suction provided. These arrangements include changing the path of airflow, disconnecting the power-driven brush, installing a converter attachment across the floor cleaning nozzle, closing off the floor cleaning nozzle, and disconnecting the belt drive for the brush and connecting a converter through the main nozzle housing directly to the fan.

Such cleaners currently on the market, powered with a single motor, and controlling or altering airflow and brush operation in various ways provide 1½" to 7" of water suction during rug or floor cleaning, and from 12" to 24" of water suction for off-the-floor cleaning.

However, we have found that while 5" to 7" of water suction is sufficient for rotary brush rug cleaning operation, in order to properly and efficiently perform off-the-floor cleaning operations on upholstery, draperies, etc., up to approximately 70" of water suction is required. Such a suction output range of 5" to 70" of water suction for a dual function cleaner does not appear to be possible using one motor of a size and cost practical for an upright suction cleaner.

We have discovered that the need that has long existed in the art may be satisfied, and that the problems which have been encountered and continue to exist with all prior art devices of which we are aware, may be solved by the new multi-motor suction cleaner construction of the invention wherein two different motors and fans driven thereby are used, selectively, for delivering the two widely different degrees of suction required for efficient agitated floor and off-the-floor cleaning operations. The new construction is characterized further by providing a dust filter located in a closed compartment carried by the floor cleaner handle, and establishing a usual airflow path of usual type from the nozzle housing and the fan of one motor-fan unit to the filter with low-suction, high-volume airflow; and establishing a path of suction airflow from a high-speed motor-fan unit located in the compartment to draw air through the filter from a flexible hose, and wand and nozzle attachments connected through a converter-diverter introduced into the normal inlet passages for the filter.

SUMMARY OF THE INVENTION

Objectives of the invention include providing a single upright suction cleaner with attachments which may be used to perform with maximum efficiency both floor and off-the-floor cleaning operations of a character that currently require two cleaners, an upright cleaner and a canister cleaner, to carry out such operations with equal efficiency; providing such a suction cleaner with separately located and selectively operated first and second motor-fan units, the first delivering low-suction, high-volume airflow and the second delivering high-suction, low-volume airflow, respectively, for floor or off-the-floor cleaning; providing such a suction cleaner with a special sealed or closed suction compartment in which the cleaner dust bag is removably located and in which said second high-suction, low-volume motor-fan unit also is located; providing such an upright suction cleaner in which said first low-suction, high-volume motor-fan unit is housed in a usual manner in the driven rotary brush nozzle housing, and in which the first motor-fan unit fan has passage connection with the dust bag in the closed suction compartment; providing such a suction cleaner with operation selector and control means movable to first and second positions, which, in the first position enables operation of the floor cleaner with said first motor-fan unit energized to carry out a floor cleaning operation, and which, in said second position disables operation of said first motor-fan unit and uncovers a first opening in a wall of the suction compartment to permit insertion of a converter attachment in a first receptacle mounted in the compartment which, when locked in said first receptacle enables off-the-floor cleaning operation of said second motor-fan unit; providing such a suction cleaner in which said operation and control means includes a first switch which, when the control means is in said first position, is closed to enable energizing of said first motor-fan unit; providing such a suction cleaner in which said first opening is uncovered when the operation and control means is in said second position establishing communication with said first receptacle and in which said first receptacle has a second switch which is closed when a converter attachment is entered into and locked in said first receptacle to permit energization of said second motor-fan unit; providing such suction cleaner in which said converter attachment has a flexible hose connected thereto, in which off-the-floor cleaning tools are removably attached to the other hose end, and in which the converter attachment, when inserted into and locked in said first receptacle, establishes communication between the flexible hose and dust bag and interrupts airflow communication between the dust bag and the upright cleaner suction nozzle housing; providing such a suction cleaner in which a second opening is formed in a compartment wall communicating with a second receptacle connected with the second motor-fan unit, in which the second receptacle has a third switch also adapted to energize the second motor-fan unit when said third switch is closed, and in which the converter attachment, when inserted into and locked in the second receptacle, actuates the third switch to closed position to energize the second motor-fan unit and to convert the cleaner to blower operation; providing a new suction cleaner construction which incorporates the foregoing objectives in a coordinated interrelated and cooperative relationship of the described components; and providing such new suction cleaner construction which achieves the stated objectives in a most efficient and readily operated manner, and eliminates difficulties and solves long-standing problems and satisfies needs that have existed for many years in the suction cleaner art.

These and other objectives and advantages may be obtained by the new suction cleaner construction the general nature of which may be stated as including a suction nozzle housing, a first motor-fan unit in the housing, an operating handle for the cleaner connected to the housing, a closed suction compartment carried by the handle, dust bag means removably mounted in the compartment, airflow passage means connecting said first motor-fan unit with the dust bag means, said passage means including a converter receptacle mounted in the compartment, a second motor-fan unit mounted in the compartment, converter means including a flexible hose, the converter means being removably connected with the converter receptacle and when so connected simultaneously blocking communication through said passage means between said first motor-fan unit and the dust bag means and establishing communication between the flexible hose and the dust bag means, and means for selectively, alternatively, operating the first or second motor-fan unit.

BRIEF DESCRIPTION OF THE DRAWINGS

A preferred embodiment of the invention - illustrative of the best mode in which applicants have contemplated applying the principles - is set forth in the following description and shown in the drawings and is particularly and distinctly pointed out and set forth in the appended claims.

FIG. 6 is an enlarged sectional view taken on the line 6—6, FIG. 2;

FIG. 7 is a further enlarged fragmentary sectional view looking in the direction of the arrows 7—7, FIG.

Figure 2:
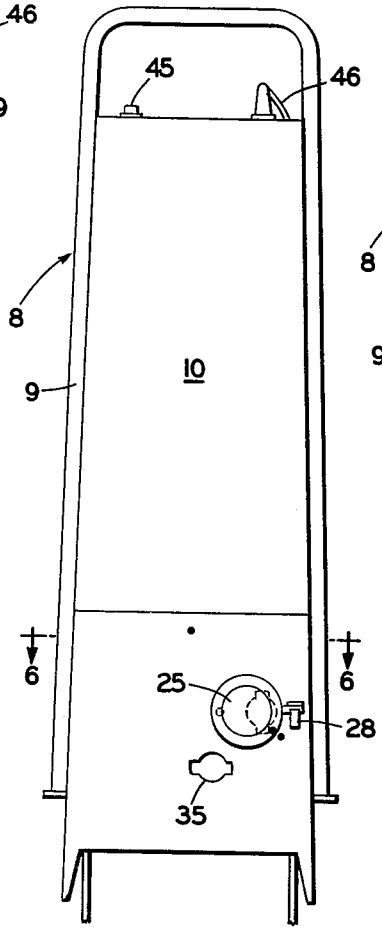
FIG. 2 is a front view of the handle assembly of the cleaner shown in FIG. 1, detached from the cleaner.
Figure 4:
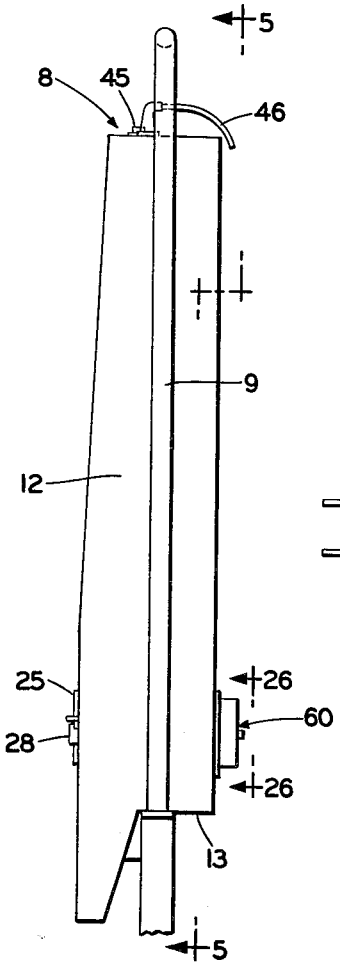
FIG. 4 is a side view of the handle looking toward the right side of FIG. 2.
Figure 28:
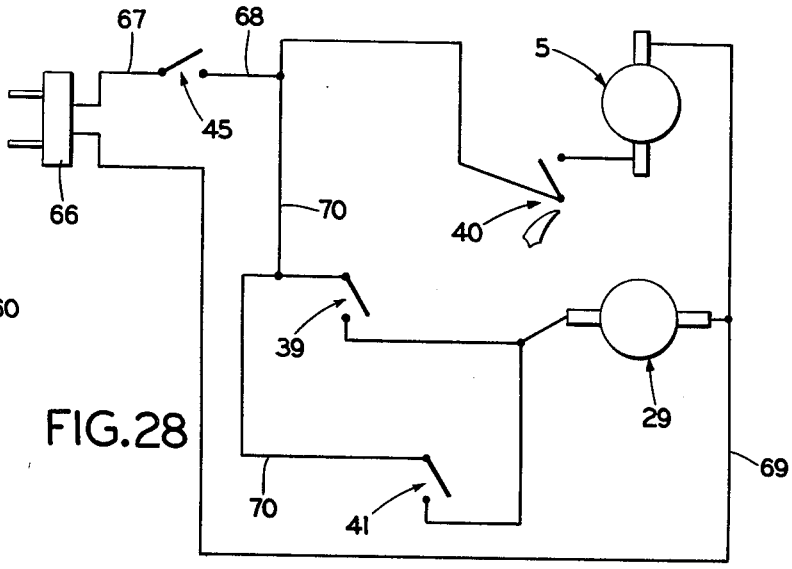
Figure 12:
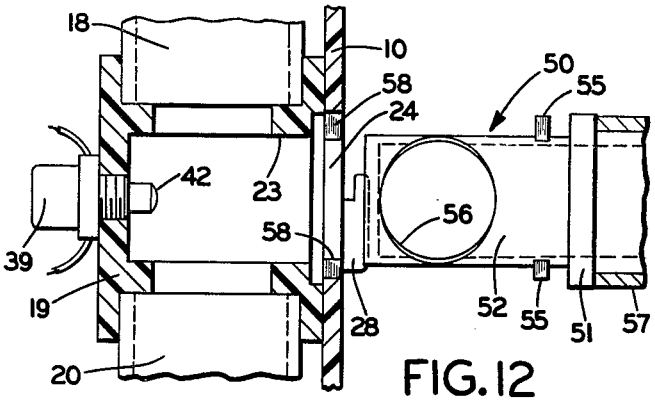
Figure 13:
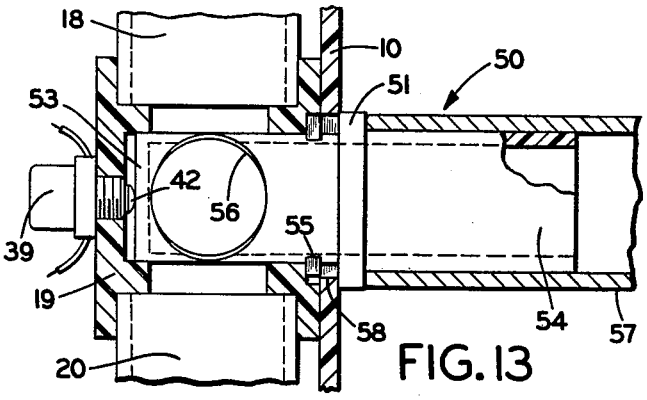
Figure 14:
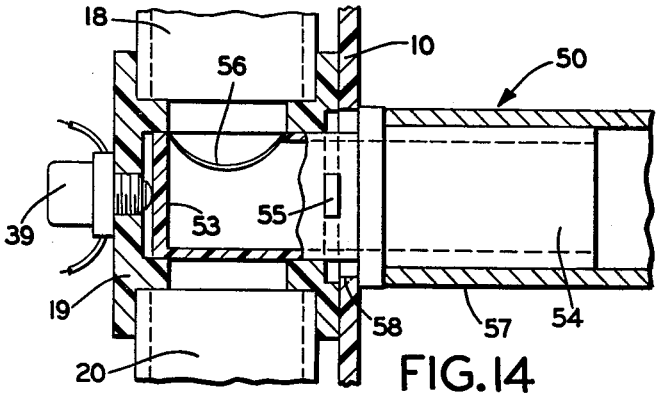
Figure 21:
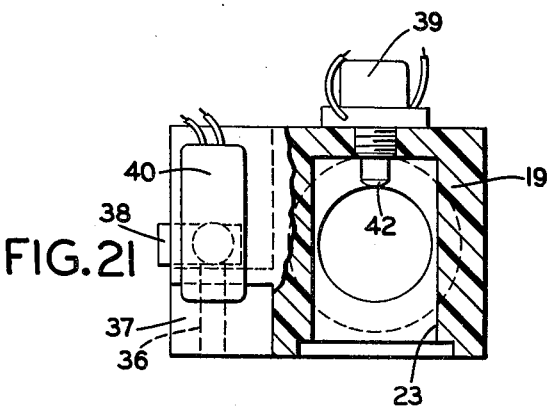
Figure 20:
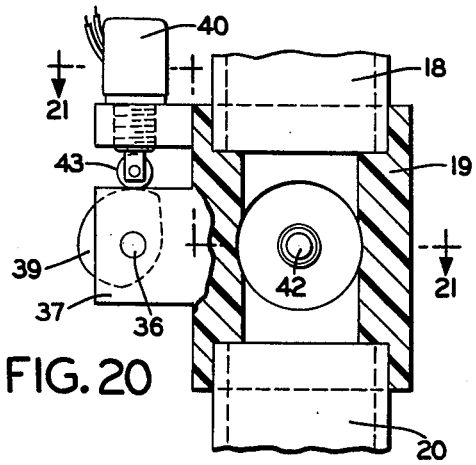
Figure 11:
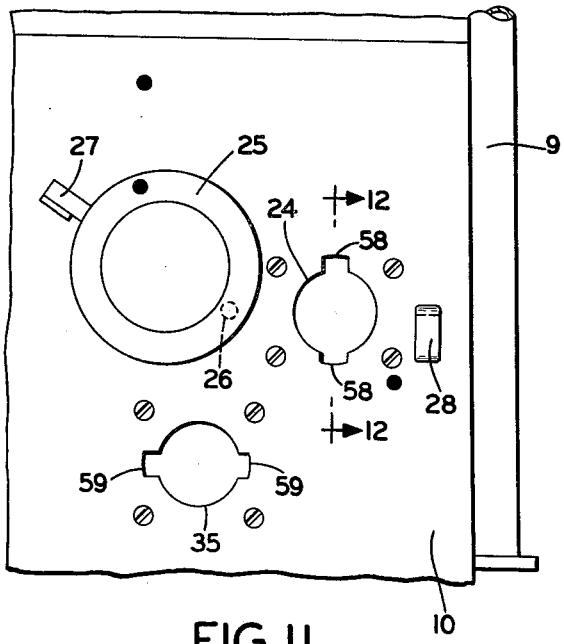
Figure 10:
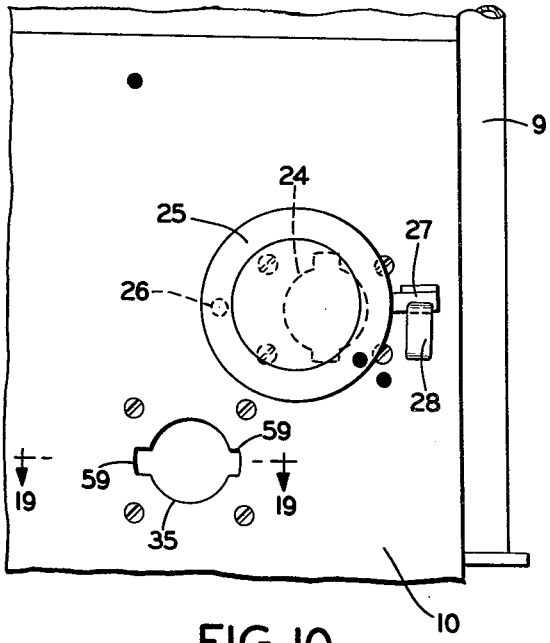
Figure 16:
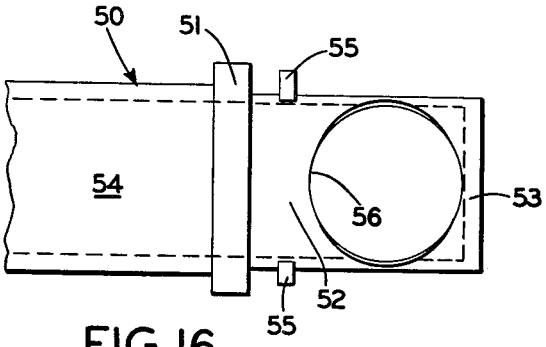
Figure 19:
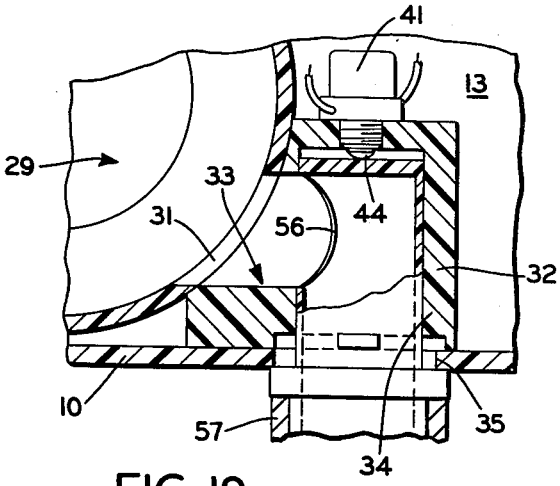
Figure 17:
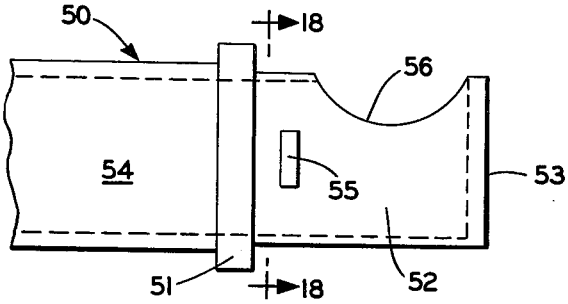
Figure 15:
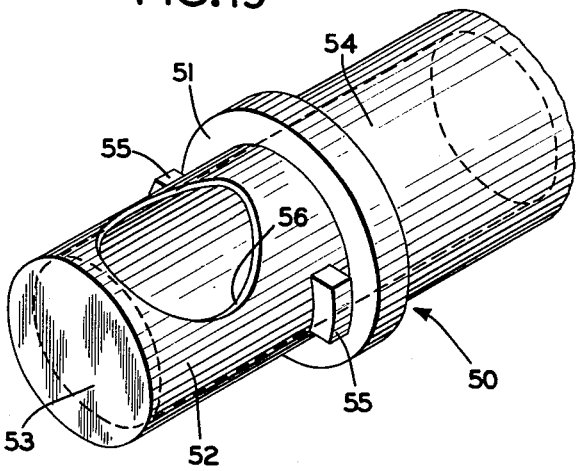
Figure 18:
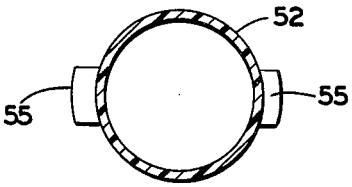
Figures 22, 23, 24, 25, 26, 27:
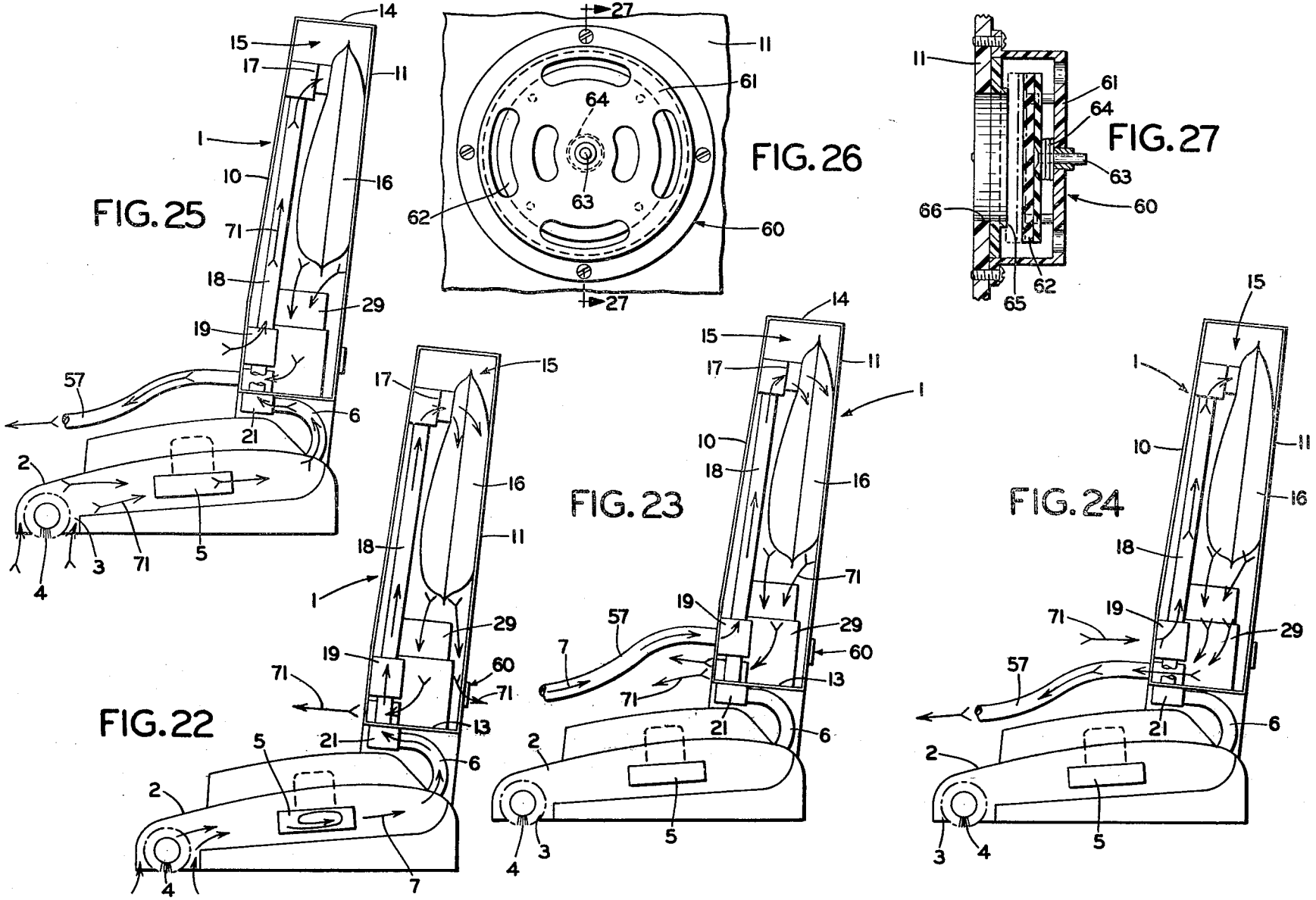

6, showing the selector knob cam control in one position of selector adjustment;

FIG. 8 is a view similar to a portion of FIG. 7 showing the selector knob in another position of selector adjustment;

FIG. 9 is a fragmentary sectional view taken on the line 9—9, FIG. 7;

FIG. 10 is an enlarged fragmentary front view of a portion of FIG. 2 showing the selector knob in the position of adjustment, also shown in FIG. 7, for rug cleaning operation of the cleaner;

FIG. 11 is a view similar to FIG. 10 but showing the selector knob in another position of adjustment, also shown in FIG. 8, for off-the-floor operation of the cleaner;

FIG. 12 is a fragmentary sectional view looking in the direction of the arrows 12—12, FIG. 11 illustrating a diverter member about to be inserted into an opening in a wall of the filter containing suction compartment of the cleaner and into the normal filter inlet passage;

FIG. 13 is a view similar to FIG. 12 showing the diverter member completely inserted into the filter inlet passage;

FIG. 14 is a view similar to FIGS. 12 and 13 illustrating the diverter member turned 90° from its position in FIG. 13 to engage bayonet joint locking connection of the diverter member with the inlet passage, and to position the diverter member in airflow diverting position;

FIG. 15 is an enlarged perspective view of the diverter member:

FIG. 16 is a fragmentary top plan view of the diverter member shown in FIG. 15;

FIG. 17 is a fragmentary side view of the diverter member shown in FIGS. 15 and 16;

FIG. 18 is a sectional view taken on the line 18—18, FIG. 17;

FIG. 19 is a view looking in the direction of the arrows 19—19, FIG. 10, of the diverter member entered into a compartment wall opening of the cleaner when the selector knob is in the rug cleaning position of adjustment for converting the cleaner to blower operation;

FIG. 20 is an enlarged fragmentary view of some of the parts shown in FIG. 6, partially in section, looking in the opposite direction of the arrows 7—7, FIG. 6;

FIG. 21 is a view, partly in section, taken on the line 21—21, FIG. 20;

FIG. 22 is a diagrammatic view illustrating the airflow during normal operation of the cleaner of the invention for cleaning carpet, rugs and the like, the dust-laden air path of flow being indicated by straight arrows, and the path of flow of clean air after the dust-laden air has passed through the filter being shown by arrows with tails;

FIG. 23 is a diagrammatic view similar to FIG. 22 but showing the airflow path when the cleaner has been adjusted for off-the-floor cleaning, the straight arrows and arrows with tails indicating dust-laden and clean air, respectively;

FIG. 24 is a diagrammatic view similar to FIGS. 22 and 23 but showing the cleaner operated as a blower with the selector knob in the position for off-the-floor cleaning, clean air being indicated by arrows with tails;

FIG. 25 is a view similar to FIG. 24 showing the cleaner being operated as a blower but with the selector knob in carpet cleaning position, clean air flow being indicated by arrows with tails;

FIG. 26 is an enlarged view looking in the direction of the arrows 26—26, FIG. 4, showing the relief valve for the closed suction compartment;

FIG. 27 is a fragmentary sectional view taken on the line 27—27, FIG. 26, illustrating the valve open in full lines and closed in dot-dash lines; and FIG. 28 is a wiring diagram for the cleaner.

Similar numerals refer to similar parts throughout the various figures of the drawings.

DESCRIPTION OF THE PREFERRED EMBODIMENT

Figure 1:
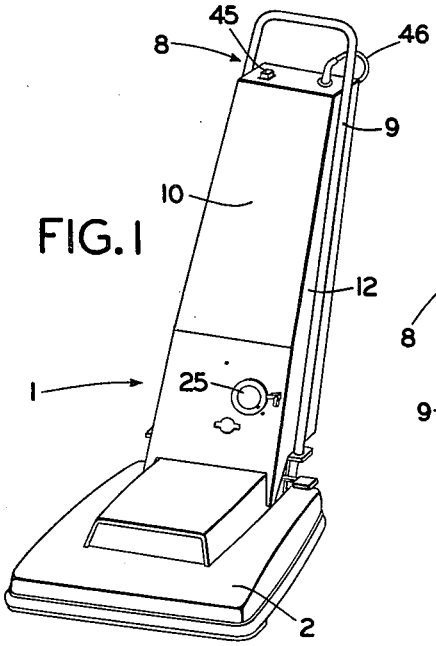
FIG. 1 is a perspective view of an upright suction cleaner in which the new construction is incorporated.

A suction cleaner of the upright or floor type incorporating the invention is indicated, generally, at 1 in FIG. 1. The cleaner 1 may include any one of a number of usual types of nozzle housings 2 mounted on casters or rollers not shown. The nozzle housing is adjustable in a usual manner for locating the main nozzle opening 3 at the desired height above a floor, carpet or rug for most efficient cleaning. A power-driven rotary brush or agitator 4 is located in the housing 2 above the main nozzle opening 3 as shown in FIGS. 22 to 25.

A usual or typical motor-fan unit 5 is located in the housing 2. When the cleaner is operated as a floor or carpet cleaner, dust-laden air is discharged from the fan of unit 5 into a preferably flexible conduit 6, as shown by the straight arrows 7 in FIG. 22.

In accordance with the invention, the cleaner handle, generally indicated at 8, includes preferably a U-shaped mounting member 9 which is pivotally connected in a known manner (not shown) to the housing 2 for cleaning manipulation. Front wall 10, rear wall 11, end walls 12, bottom wall 13, and top wall 49 (FIGS. 2 to 5) form a closed suction compartment generally indicated at 15 in FIG. 5 and also in FIGS. 22 to 25.

A typical or usual dust filter bag 16 formed of usual material, such as suction cleaner filter bag paper, is mounted within the compartment 15 as shown in FIGS. 22 to 25. The filter bag 16 is omitted from FIG. 5 for clarity but may be removably connected with the opening 17 at the end of the filter inlet passage tube 18.

Figure 3:
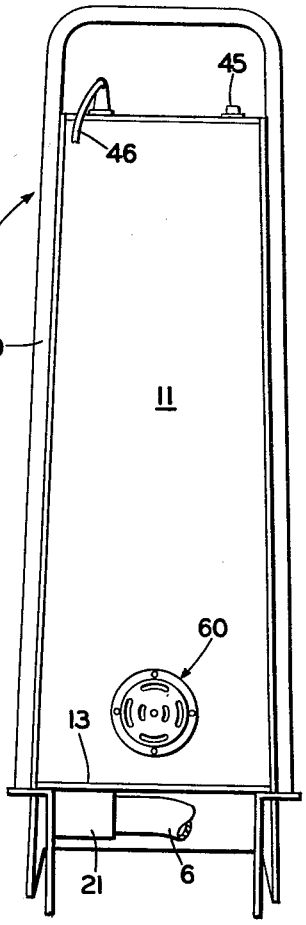
FIG. 3 is a rear view of the handle shown in FIG. 2.
Figure 5:
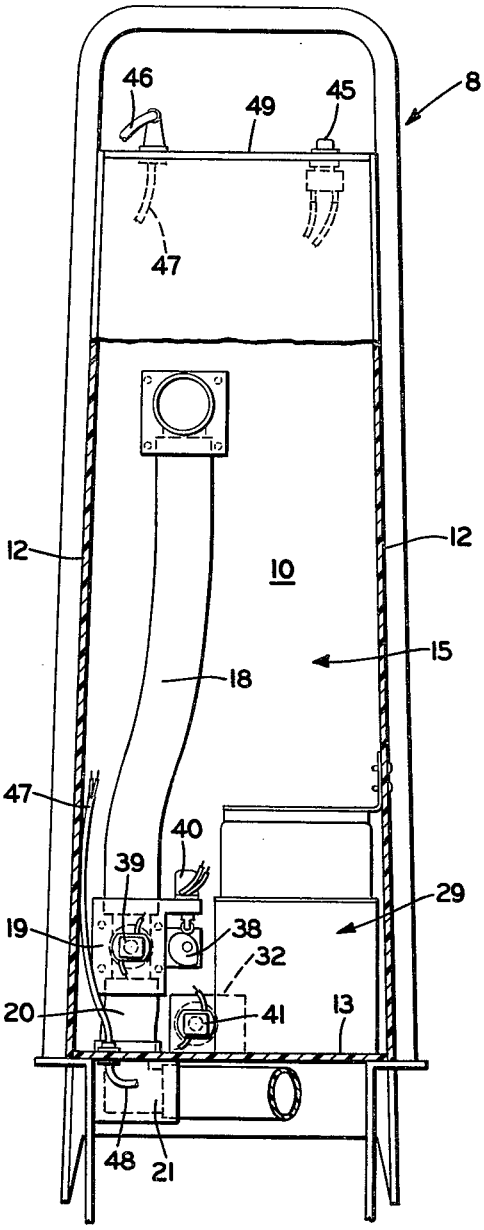
FIG. 5 is an enlarged sectional view of the handle taken on the line 5—5, FIG. 4, with the filter removed.

The passage tube 18 extends downward (FIGS. 5 and 7) within suction compartment 15 to the converter receptacle 19. The lower end of receptacle 19 is connected by a tube 20 with an elbow 21 mounted on the compartment bottom wall 13. The elbow 21 has a reduced neck 22 extending through the bottom wall 13, and the flexible conduit 6, which extends from the nozzle housing motor-fan unit 5, is connected to the other end of the elbow 21, as shown in FIGS. 3, 5 and 7, as well as in FIGS. 22 to 25.

The converter receptacle 19 is formed with T-shaped passages and the central laterally extending portion 23 thereof is connected with or registers with a converter opening 24 formed in the front compartment wall 10 (FIGS. 6, 11 and 12). The opening 24 normally is closed by the disc-like selector knob 25 (FIG. 10) when the cleaner is operated for floor and rug cleaning. The selector knob 25 is pivotally mounted at 26 on the front compartment wall 10 and, in such closed position, the actuating arm 27 of selector knob 25 is engaged in a keeper 28 (FIGS. 2 and 10).

A second motor-fan unit 29 is mounted in the compartment 15 on the compartment bottom wall 13. The motor-fan unit 29 has a suction inlet 30 (FIG. 6) at its upper end and a blower outlet 31 near its lower end (FIGS. 7 and 19).

A blower receptacle 32 is mounted on the compartment bottom wall 13 having an elbow-like passage therein. One leg 33 of the passage is connected with a blower outlet 31 of the motor-fan unit 29 (FIGS. 7 and 19) and the other leg 34 of the passage in receptacle 32 communicates with the blower opening 35 formed in the front compartment wall 10 (FIGS. 10 and 11).

The pivotal mounting 26 for the selector knob 25 includes a shaft 36 which is journaled in a lug 37 projecting from the converter receptacle 19 (FIGS. 7 and 9). The end of the shaft 36 has a cam 38 mounted thereon movable between two positions shown respectively in FIGS. 7 and 8 when the selector knob 25 is in closed position of FIG. 7 or open position of FIG. 8.

The converter receptacle 19 is equipped with control switches 39 and 40 (FIG. 9); and the blower receptacle 32 is equipped with a control switch 41 (FIG. 19). The function and operation of these switches will be described later. Switch 39 has a plunger actuator 42, switch 40 has a roller 43 engaging cam 38 for switch actuation, and switch 41 has a plunger actuator 44.

There is also a normal rug cleaning control switch 45 located near the top of the handle 8 (FIG. 5) and the usual power supply cord 46 may extend from the top of the handle 8 to a usual plug. The power supply 46 has wiring 47 extending through the compartment 15 and emerging from the compartment bottom wall 13 at 48 to supply power to the motor-fan unit 5. The motor-fan unit 29 also is supplied with power through wiring described below.

The rear wall 11 of the compartment 15 may be hinged preferably at its lower end to the compartment bottom wall 13 for opening movement to expose the compartment 15 and to gain access to the dust filter bag 16 for bag changing. Optionally, the rear wall 11 may be completely removable. In either case the rear wall when closed is sealed to provide the closed suction compartment 15. FIG. 5 illustrates the compartment 15 when open giving access to all components located in the compartment 15.

In accordance with the invention, a special converter attachment member is provided illustrated generally at 50 in FIG. 15. The member 50 is tubular in structure having a central locator flange 51. A tube portion 52 closed at its outer end by wall 53 extends in one direction from the flange 51, and an open-ended tube portion 54 extends in the other direction from flange 51. Bayonet joint locking lugs 55 spaced from the flange 51 project outwardly of the tube portion 52 and an opening 56 is formed in the tube portion 52 intermediate the flange 51 and the end wall 53.

The member 50 is mounted in a usual manner as by connector end of a flexible hose of a type usually supplied with upright cleaners for off-the-floor cleaning purposes with various nozzle attachments and the like removably mounted on the end of the hose remote from a converter attachment. An end of such flexible hose may be telescoped over and secured to the tube portion 54 of member 50, with its end preferably engaging locator flange 51 as illustrated in FIGS. 12, 13 and 14 at 57.

The converter attachment member 50 is adapted for connection with the converter receptacle 19 as well as the blower receptacle 32. The end 52 of a member 50 is illustrated in FIG. 12 about to be inserted through the converter opening 24 into and telescoped within the central lateral portion 23 of a converter receptacle 19. The converter member 50 is shown fully telescoped into the receptacle 19 in FIG. 13 and the closed end wall 53 thereof has engaged the plunger actuator 42 of switch 39 to actuate the switch 39 to its second position.

At this time, the bayonet joint locking lugs 55 have entered the notches 58 in the converter opening 24 (FIG. 11). The converter 50 is then rotated 90° clockwise (viewing FIG. 11) to the position shown in FIG. 14 which engages the bayonet joint and locks the converter member 50 to the converter receptacle 19 with the opening 56 presented upwardly in direct communication with the filter inlet passage tube 18 at the lower end of the latter.

The described assembly of a converter member 50 with the converter receptacle 19 converts the cleaner to off-the-floor operation status more fully described below.

The converter attachment member 50 has an additional function for converting the cleaner 1 to blower operation by inserting the end 52 of the member 50 through the blower opening 35 with the bayonet joint lugs 55 oriented to enter the notches 59 formed in the contour of the opening 35 (FIG. 11). Such insertion permits telescoping the tube portion 52 into the blower receptacle 32 elbow leg 34 as shown in FIG. 19 with the opening 56 directed upward. The member 50 then is rotated counterclockwise 90° to engage the bayonet joint lugs 55 against the back of front compartment wall 10, as shown in FIG. 19. At this time, the opening 56 is aligned with the passage portion in the leg 33 of the blower receptacle 32, and, thus, communicates with the blower outlet 31 of the motor-fan unit 29.

The suction compartment 15 is provided with a relief valve, generally indicated at 60, located near the lower end of the rear wall 11 of the compartment 15 as shown in FIG. 3. The relief valve (FIGS. 26 and 27) has an open cage 61 in which a movable, preferably rubber, diaphragm 62 is mounted on pin 63 and is biased by spring 64 toward sealing ring 65 which surrounds an opening 66 formed in the compartment rear wall 11. The valve 60 is shown in closed position in dot-dash lines, and in open position in full lines in FIG. 27.

When pressure exists in compartment 15, the valve is forced open to relieve pressure in the compartment from air passing through the dust filter bag 16 when the cleaner is operated for rug and floor cleaning. At this time, air under pressure also can escape from the compartment through the motor-fan unit 29 which does not operate during floor cleaning as only the motor-fan unit 5 is energized.

When high suction exists in compartment 15, during operation of the motor-fan unit 29, the relief valve 60 is closed by atmospheric pressure against the outside of diaphragm 62 and because of suction existing in compartment 15.

The plug of usual type for 110 volt power supply is indicated in the wiring diagram, FIG. 28, at 66. One line 67 from plug 66 is connected with the master control switch 45. A line 68 runs from switch 45 to cam actuated switch 40 which is normally open or "off" but is closed by cam action of cam 38 in the position shown in FIG. 7 which occurs when the selector knob 25 is in rug or floor cleaning position as shown in FIGS. 7 and 10. When the switch 40 is closed and master switch 45 closed, the motor-fan unit 5 is energized receiving power from lines 67 and 69, the two lines from plug 66.

The cam 38 allows the switch 40 to open when the selector knob 25 is moved to off-the-floor cleaning position shown in FIGS. 8 and 11.

Branch line 70 leads to switch 39 which, when closed, energizes the motor-fan unit 29 also connected with the power line 69. Branch line 70 is also connected with switch 41 which, when closed, also energizes motor-fan unit 29.

Thus, the motor in motor-fan unit 5 in the nozzle housing 2 operates for rug cleaning and is activated when the master switch 45 is closed. At this time the motor of motor-fan unit 5 is energized by switch 40 held closed through roller actuator 43 engagement with cam 38 when the selector knob 25 is in the floor cleaning position (FIG. 7).

The motor in the motor-fan unit 29 mounted in the suction compartment 15 is energized when the master switch 45 is closed by the converter member 50 when the end 53 thereof engages the switch actuator 42 and depresses the same as the member 50 is locked in engaged position in the converter receptacle 19 as shown in FIGS. 13 and 14.

Similarly the motor of motor-fan unit 29 also is energized when the master switch 45 is closed and when the converter member 50 is engaged and locked in the blower receptacle 32 by depression of the switch actuator 44 of switch 41, as shown in FIG. 19.

THE MOTOR-FAN UNITS

In accordance with the invention, the motor-fan units 5 and 29 have completely different characteristics determined by the motor and fan constructions of each unit. The motor-fan unit 5 produces low-suction, high-volume airflow for rug and floor cleaning operation. Normally, suction of 5" to 7" of water is sufficient for rotary brush rug cleaning operation. A motor and fan construction which may operate at 8,000 to 12,000 rpm at no load with a fan producing maximum airflow through the cleaner housing 2 of 80 to 100 cu. ft. of air per minute is satisfactory. A motor-fan unit used for this purpose may be an Amtek, Kent, Ohio, Unit No. E5940.

The motor-fan unit 29, on the other hand, is a high-suction, low-volume unit producing a suction of up to approximately 70" of water in the flexible hose 57 under no load when operating which is the desirable condition under which off-the-floor cleaning can be carried out most efficiently with hose and nozzle attachments connected with the suction compartment 15. A motor-fan unit delivering such suction may be an Amtek, Kent, Ohio, Unit No. E5878. The motor of such unit may run up to approximately 22,000 rpm.

CLEANER OPERATION

For Floor, Rug, etc., Cleaning

Assume that the cleaner appears generally as in FIGS. 1 and 10. The selector knob 25 is in the position shown in FIGS. 7 and 10 and switch 40 is in the actuated or closed position.

The operator plugs plug 66 into an energized socket and actuates master switch 45 at the top of the handle 8 energizing motor-fan unit 5. The cleaner is moved to and fro across the floor to perform the cleaning operation. The usual known adjustment of the nozzle 2 is made to position the nozzle opening 3 and rotary brush 4 at the most efficient cleaning position, as is usual in the operation of an upright floor cleaner. When floor cleaning has been accomplished, the master switch 45 is again actuated to open the switch and the motor-fan unit 5 is de-energized.

Throughout the floor cleaning operation described, the relief valve 60 is forced open by compartment pressure to relieve such pressure in the compartment 15. Some of the clean air indicated by the arrows with tails 71 also escapes through the motor-fan unit 29 and from the motor-fan unit to the atmosphere through the blower receptacle 32 (FIG. 22).

Off-the-Floor Cleaning

When the operator, after performing floor cleaning, wishes to continue with off-the-floor cleaning, the master switch is not turned off or opened but the selector knob 25 is turned to off-the-floor cleaning position of FIGS. 8 and 11. This moves cam 38 to the position of FIG. 8, opening switch 40 and de-energizing motor-fan unit 5. A converter attachment 50, with attached hose and any selected nozzle attachment, is then positioned so as to enter or engage the attachment member 50 in the converter opening 24 as shown in FIGS. 12, 13 and 14.

When member 50 is inserted fully into converter receptacle 19, switch 39 is closed by depressed actuator 42 which has been engaged by the converter wall 53 as shown in FIG. 13. This energizes the motor-fan unit 29 which establishes a condition of high suction in the suction compartment 15. High suction in the compartment 15 around the dust bag 16 draws dust-laden air, indicated by the straight arrows 7 in FIG. 23, through the hose 57, converter receptacle 19 and filter inlet passage tube 18 into the dust bag 16 where the dust is deposited. The clean air drawn through the dust bag 16 passes through the motor-fan unit 29 and is discharged (low volume) through the fan outlet 31, blower receptacle 32 and blower opening 35 to the atmosphere. Clean air is indicated by the arrows with tails 71, as shown in FIG. 23.

During off-the-floor cleaning operation, the relief valve 60 closes from external atmospheric pressure greater than the condition of high-suction in compartment 15, and by the action of the relief valve spring 64.

Blower Operation

At any time during or after off-the-floor cleaning, the operator may desire to use the cleaner as a blower for delivering a blast of air from a nozzle or other attachment at the end of the flexible hose 57. To enable such blower operation, the converter attachment 50 is removed from the converter receptacle 19 and connected with the blower receptacle 32 (FIGS. 19 and 24). As the converter attachment 50 is removed from the converter receptacle 19, the switch actuator 42 of switch 39 is released (FIGS. 12 and 13), switch 39 opens, and motor-fan unit 29 is de-energized.

However, when the converter attachment 50 is connected with blower receptacle 32, the switch actuator 44 of switch 41 is engaged. This closes switch 41 and re-energizes motor-fan unit 29 so that the fan thereof (high-suction, low-volume) blows air under high pressure from the outlet end of flexible hose 57.

All air passing into and out of the compartment 15 during such blower operation is clean air indicated by the arrows with tails 71 in FIG. 24.

At the conclusion of blower operation of the cleaner 1 as illustrated in FIG. 24, the motor-fan unit 29 is de-energized by removal of the converter attachment 50 from the blower receptacle 32, which results in opening switch 41. Of course, alternatively, at the conclusion of such blower operation or, in fact, at the end of any cleaning operation described above, one or the other of the motor-fan units 5 or 29 may be stopped by actuating the master switch 45.

In event that the cleaner has been operated for floor cleaning as shown in FIG. 22, to convert to blower operation, it is only necessary to insert the converter attachment 50 into the blower receptacle 32, with the selector knob 25 remaining in the floor cleaning position of FIG. 10. Under these conditions, both motor-fan units 5 and 29 are energized, the cam 38 holding the switch 40 closed and the motor-fan unit 5 energized, and the converter attachment 50 holding the switch 41 closed energizing the motor-fan unit 29.

During the blower operation described immediately above, the cleaner nozzle housing 2 should be adjusted to the highest nozzle position possible to hold the nozzle above and spaced from the floor or carpet. Otherwise, the power-driven brush 4, which will be revolving continuously, will engage with the floor or carpet on which the cleaner is resting which is undesirable. Further, the nozzle opening 3 might be closed off against a carpet area increasing the load on the motor-fan unit 5. The airflow under blower operation of FIG. 25 is indicated by the clean air arrows with tails 71.

IN GENERAL

The new concept of the invention is characterized by the cooperative and interrelated coordination of a number of elements or components of the multi-motor cleaner. These components include the two separate and normally selectively and alternately operated motor-fan units 5 and 29 having radically different suction characteristics, one producing low-suction, high-volume airflow and the other producing high-suction, low-volume airflow.

The second of such components is the suction compartment 15 which is closed and well sealed compartment because in one mode of operation, high suction established by the motor-fan unit 29 must be maintained in the compartment. The compartment 15 is involved in two different and selective modes of operation. In one mode, the low-suction floor cleaner operation, the compartment 15 is a part of a usual airflow system of a floor cleaner wherein air is drawn into the cleaner nozzle by the motor-fan unit 5 in the nozzle housing and exhausts through the dust bag 16 into the compartment 15 and through compartment outlets 35 and 60.

In the second mode of high-suction off-the-floor cleaner operation, the high suction is established in the compartment 15 by the motor-fan unit 29 located in the compartment. This high suction draws dust-laden air from the hose 57 into and through the dust bag 16. The compartment 15 functions as a part of the air system when the cleaner is operated as a blower with the motor-fan unit 29 energized or with both of the motor-fan units 5 and 29 energized.

Thus, the suction compartment 15 acts as an exhaust chamber for floor cleaning and alternately as a source of suction for off-the-floor cleaning; and it acts as both an intake and an exhaust passage for blower operation. Further, it acts as a container for the dust bag 16. The compartment 15 has two intake openings 24 and 21 and two exhaust or outlet openings 35 and 60. Opening 35 is always open and air flows out of the compartment to aid in the motor cooling.

The next component is the selector knob 25 which controls the on-off position of switch 40, respectively, for the floor cleaning mode of operation when the selector knob is in floor cleaning position, and for off-the-floor cleaning when the selector knob is in off-the-floor cleaning positions. The selector knob, when moved from floor cleaning to off-the-floor cleaning position, cuts off the motor-fan unit 5 and uncovers the opening 24 to receive the converter attachment 50.

The next such component is the converter attachment member 50 with the flexible hose connected thereto adapted for attachment of various cleaning tools and the like of usual construction at the outer end of the hose. When the converter attachment 50 is inserted and locked in either the converter receptacle 19 or the blower receptacle 32 it controls operation of the motor-fan unit 29, by actuating either the switch 39 or the switch 41 to energize the motor-fan unit 29 for either off-the-floor or blower operation when the selector knob 25 is in the off-the-floor position.

When the converter attachment 50 is locked in the converter receptacle 19, it intercepts the airflow system running from the nozzle housing 2 to the dust bag 16, and provides a suction inlet from the hose to the dust bag for high suction operation of the cleaner.

The other components involved in the cooperative relationship are the converter and blower receptacles and the switches operatively associated therewith which have been described.

The cleaner 1 of the invention, constructed and operated in accordance with the foregoing description, provides a single cleaner that can be used for every cleaning function in the most efficient manner, performance of which currently requires both a canister cleaner and an upright cleaner.

Such operations are carried out very simply and easily merely by selectively uncovering an opening in a wall of a suction compartment containing a motor-fan unit and a filter, and connecting an attachment hose thereto with a converter member; or by closing said opening after removal of the converter member to convert the cleaner to conventional normal upright cleaner operation.

A further unusual advantage of the new construction is that the cleaner can be converted to blower operation by connecting the same converter member to a blower receptacle contained in the suction compartment accessible through another opening in a wall of the suction compartment.

Accordingly, the new multi-motor suction cleaner, characterized by the concepts of the cooperative and interrelated or coordinated components described above, and their construction and and operation also fully described, satisfies the objectives stated, eliminates difficulties that have existed for years in the suction cleaner art, solves a problem repeatedly recognized in the prior art for over fifty years, attains the new results described, and satisfies a most important need existing in the art.

In the foregoing description, certain terms have been used for brevity, clearness and understanding but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described.

Having now described the features and principles of the invention, the manner in which the new multi-motor suction cleaner is constructed and operated, the pre-ferred characteristics of the components of the suction cleaner, and the advantageous, new and useful results obtained; the new and useful structures, devices, components, elements, arrangements, uses and relationships are set forth in the appended claims.

We claim:

1. Multi-motor suction cleaner construction including
(a) a suction nozzle housing,
(b) a first motor-fan unit in the housing in communication with the suction nozzle,
(c) an operating handle for the cleaner connected to the housing,
(d) a closed suction compartment carried by the handle,
(e) dust bag means removably mounted in the compartment,
(f) airflow passage means connecting said first motor-fan unit with the dust bag means,
(g) said passage means including a converter receptacle mounted in the compartment,
(h) a second motor-fan unit mounted in the compartment having a suction inlet in communication with the suction compartment,
(i) converter means including a flexible hose having a connector end,
(j) the converter means connector end being removably connected with the converter receptacle and when so connected simultaneously blocking communication through said passage means between said first motor-fan unit and the dust bag means and establishing communication between the flexible hose and the dust bag means,
(k) and means including said connector end and first and second switch means for selectively, alternatively, operating the first or second motor-fan unit;
(l) whereby the second motor-fan unit is operated and the first motor-fan unit is disabled when the hose connector end is connected with the converter receptacle.

2. The construction defined in claim 1 in which the nozzle housing contains a power driven rotary brush.

3. The construction defined in claim 1 in which the first motor-fan unit under load develops a suction of up to 7" of water at the housing nozzle, and in which the second motor-fan unit under load develops a suction of up to 70" of water in the flexible hose.

4. The construction defined in claim 1 in which the first motor-fan unit produces low-suction, high-volume airflow developing under load floor cleaning suction at the noZzle of 5" to 7" of water and of from 80 to 100 cu. ft. of air per minute; and in which the second motor-fan unit develops under load off-the-floor cleaning high-suction, low-volume airflow of approximately 70" of water in the flexible hose.

5. The construction defined in claim 1 in which the airflow passage means has two ends one of which is located in the compartment and the second of which is located outside of the compartment; in which the dust bag means is removably mounted on said one passage means end; and in which the first motor-fan unit is connected with said second passage means end.

6. The construction defined in claim 1 in which the closed suction compartment is provided with relief valve means; in which the relief valve means automatically opens from airflow pressure in the compartment when the first motor-fan unit is operating; in which the relief valve means is closed automatically by the suction developed in the compartment when the second motor-fan unit is operating; and in which the compartment suction when the second motor-fan unit is operating draws air into and through the hose and dust bag means.

7. The construction defined in claim 1 in which the closed suction compartment is provided with relief valve means; in which in one mode of cleaner operation high-suction is established and maintained in the compartment by the second motor-fan unit to produce airflow into and through the hose and dust bag means; and in which in a second mode of operation the suction compartment acts as a receiver for discharge through the relief valve and second motor-fan unit of airflow delivered to the compartment by operation of the first motor-fan unit.

8. The construction defined in claim 1 in which the second motor-fan unit has a blower outlet, in which a blower receptacle is mounted in the compartment communicating with said blower outlet and with the exterior of the compartment; in which the hose has an outlet end; in which the converter means connector end is removably mounted in the blower receptacle; in which when the converter means is so connected with the blower receptacle and the second motor-fan unit is operated, high-pressure air is blown from the hose outlet end; and in which there is normally open third switch means actuated by connecting the converter means with the blower receptacle to enable energizing said second motor-fan unit.

9. The construction defined in claim 8 in which the compartment and converter receptacle act as an airflow inlet for air blown under high pressure from the outlet end of the hose when the converter attachment is connected with the blower receptacle and the second motor-fan unit operated.

10. The construction defined in claim 8 in which the compartment receives inlet airflow from both the nozzle housing and the converter receptacle for air blown under high pressure from the outlet end of the hose when both the first and second motor-fan units are operated at the same time while the suction nozzle is raised from a surface on which the cleaner rests.

11. The construction defined in claim 1 in which there are walls forming the closed suction compartment; and in which the means for selectively, alternatively, operating the first or second motor-fan unit includes an opening formed in one of said walls communicating with the converter receptacle, and a selector and control member pivotally mounted on said one wall movable to first and second positions, respectively, enabling or disabling operation of the first motor-fan unit and covering or uncovering said one opening; whereby when said selector and control member is in said second position and said opening is uncovered, the coverter means may be connected with the converter receptacle.

12. The construction defined in claim 11 in which the converter receptacle is provided with said first switch means which is maintained closed by the selector and control member when the selector and control member is in said first position; and in which said first switch is released to open when said selector and control member is moved to said second position.

13. The construction defined in claim 12 in which the pivotal mounting of the selector and control member includes cam means actuating said first switch means holding the first switch means closed when the control member is in said first position and releasing said first switch to open when said control means is in said second position; and in which said first switch means is connected with said first motor-fan unit to permit said first motor-fan unit to be enabled or disabled, respectively, when said first switch means is closed or open.

14. The construction defined in claim 1 in which the converter means connector end includes a tubular wall portion having an opening therein and having a closed end wall; in which the converter receptacle is formed with T-shaped passages including first and second aligned passage openings and a lateral passage opening into which said tubular wall portion may be telescoped; in which said second switch means is normally open and is mounted on the converter receptacle having an actuator extending axially into said lateral passage; in which said tubular wall portion is telescoped into said lateral passage to connect the converter means to said converter receptacle; in which locking means is provided between the converter means and converter receptacle to interengage and lock the converter means with and to the receptacle when said tubular wall portion is fully telescoped into said lateral passage; in which said second switch means actuator is engaged by the tubular portion end wall when the converter means is locked to the converter receptacle to close said second switch means; and in which closing said second switch means enables operation of the second motor-fan unit.

15. The construction defined in claim 14 in which said tubular wall portion when the converter means is locked in the converter receptacle blocks one of said T-shaped passage end openings and the tubular wall portion opening communicates with the other T-shaped passage end opening.

16. The construction defined in claim 14 in which the locking means to interengage and lock the converter means with and to the receptacle comprises bayonet joint locking means.

17. The construction defined in claim 1 in which the converter means connector end includes a tubular wall portion having an opening therein and having a closed end wall; in which a second receptacle communicating with the interior and exterior of the compartment is mounted in the compartment; having an exteriorly accessible tubular opening into which said tubular wall portion may be telescoped; in which said tubular wall portion is telescoped into said tubular opening to connect the converter means to said second receptacle; in which locking means is provided between the converter means and second receptacle to interengage and lock the converter means with and to said second receptacle when said tubular wall portion is fully telescoped into said tubular opening; in which normally open third switch means is mounted on said second receptacle having an actuator extending axially into said tubular opening; in which said third switch means actuator is engaged by the tubular portion end wall when the converter means is locked to said second receptacle to close said third switch means; and in which closing said third switch means enables operation of the second motor-fan unit.

18. The construction defined in claim 1 in which the converter means when connected with said converter receptacle engages and closes said second normally open switch means which is carried by the converter receptacle to enable operation of the second motor-fan unit coincidentally with the converter means simultaneously blocking communication between the suction nozzle housing and the dust bag means and establishing communication between the hose and dust bag means.

19. The construction defined in claim 1 in which a second receptacle is mounted in the compartment communicating between the interior and exterior of the compartment; in which the converter means may be selectively, alternatively, removably connected with either the converter or second receptacle; in which the converter and second receptacles are provided respectively with said second switch means and with third switch means each normally open and operatively connected with the second motor-fan unit; and in which the converter means when connected with either of the converter or second receptacles closes the related second or third switch means to enable operation of the second motor-fan unit.

20. The construction defined in claim 19 in which the converter receptacle has passage means communicating with the exterior of the compartment with which said converter means is removably connected; in which selector and control means is mounted on the compartment movable between one position covering and a second position uncovering said converter receptacle passage means; in which said first switch means is mounted on the converter receptacle connected with the first motor-fan unit; in which said first switch means is normally closed when the selector and control means covers said converter receptacle passage means; and in which movement of the selector and control means to uncover said converter receptacle passage means opens said first switch means to disable said first motor-fan unit.

21. The construction defined in claim 1 in which the converter receptacle has said first and second switch means mounted thereon; in which movable selector and control means normally prevents access to said converter receptacle from the exterior of the compartment; in which said control means when in access-preventing position holds said first switch means closed to enable operation of the first motor-fan unit; in which said control means when moved out of access-preventing position releases said first switch means to open and permits converter means connection with said converter receptacle; and in which connection of the converter means with said converter receptacle actuates the normally open second switch means to close the switch means to thereby enable operation of the second motor-fan unit.

22. A converter device for an upright suction cleaner of the type having a suction nozzle housing provided with a first motor-fan unit in the housing; the device including, (A) walls forming a suction compartment adapted to be mounted on a cleaner housing;

(b) a second motor-fan unit mounted in the compartment having a suction inlet in communication with the suction compartment;

(c) airflow passage means extending through a compartment wall having one end in the compartment and a second end outside the compartment;

(d) the passage means also including a converter receptacle in the compartment intermediate the passage means ends;

(e) dust bag means in the compartment removably mounted on said one passage means end;

(f) the other passage means end being adapted to be connected to a cleaner suction nozzle housing;

(g) converter means including a flexible hose;

(h) the converter means being removably connected with said converter receptacle, and when so connected simultaneously blocking communication through said passage means between the first and second passage means ends and establishing communication between said flexible hose through said dust bag means with said compartment;

(i) and means including second normally open switch means actuated upon connecting the converter means with the converter receptacle to enable energizing said second motor-fan unit.

23. The converter device defined in claim 22 in which the suction compartment is adapted to be mounted on a cleaner handle pivotally mounted on a cleaner.

24. The converter device defined in claim 22 in which the second motor-fan unit under load develops a suction of up to ten times that suction developed by a first motor-fan unit provided in the housing of a cleaner on which the converter device is adapted to be mounted.

25. The converter device defined in claim 24 in which the second motor-fan unit under load develops a suction of approximately 70″ of water in the flexible hose.

26. The converter device defined in claim 22 in which the closed suction compartment is provided with relief valve means which is maintained closed when suction exists in the compartment and which automatically opens when pressure exists in the compartment.

27. The converter device defined in claim 22 in which a blower receptacle separate from the converter receptacle is provided communicating with the compartment; and in which the converter means may be removably connected with the blower receptacle.

28. The converter device defined in claim 27 in which the converter and blower receptacles are provided, respectively, with said second switch means and with third normally open switch means each operatively connected with the second motor-fan unit; and in which the converter means when connected with either of the converter or blower receptacles closes the related second or third switch means to enable operation of the second motor-fan unit.

29. The converter device defined in claim 22 in which said second switch means actuated to enable energizing the second motor-fan unit is a normally open switch means operatively connected with the second motor-fan unit; and in which the converter means closes said second switch means when the converter means is connected with the converter receptacle.

30. The converter device defined in claim 22 in which the converter receptacle has passage means communicating with the exterior of the compartment with which said converter means is removably connected; in which selector and control means is mounted on the compartment movable between one position covering and a second position uncovering said converter receptacle passage means; in which first switch means is mounted on the converter receptacle adapted to be connected with said first motor-fan unit provided for an upright suction cleaner; in which said first switch means is normally closed when the selector and control means covers said converter receptacle passage means; and in which movement of the selector and control means to uncover said converter receptacle passage means opens said first switch means.

31. The converter device defined in claim 30 in which the means actuated to enable energizing the second motor-fan unit is said second switch means which is connected with the second motor-fan unit, and which the converter means closes upon connecting the converter means with the converter receptacle.

32. The converter device defined in claim 22 in which a blower receptacle separate from the converter receptacle is provided communicating with the compartment; in which the converter means may be removably connected with the blower receptacle; in which the converter and blower receptacles each have passage means communicating with the exterior of the compartment with which said converter means is removably connected; in which selector and control means is mounted on the compartment movable between one position covering and a second position uncovering said converter receptacle passage means; in which first switch means is mounted on the converter receptacle adapted to be connected with said first motor-fan unit provided for an upright suction cleaner; in which said first switch means is normally closed when the selector and control means covers said converter receptacle passage means; in which movement of the selector and control means to uncover said converter receptacle passage means opens said first switch means to prevent operative connection of the first switch means with said first motor-fan unit; in which the converter and blower receptacles are provided, respectively, with said second and third normally open switch means each operatively connected with the second motor-fan unit; and in which the converter means when connected with either of the converter or blower receptacles closes the related second or third switch means to enable operation of the second motor-fan unit.

* * * * *